US011779853B2

(12) United States Patent
Forgrave et al.

(10) Patent No.: US 11,779,853 B2
(45) Date of Patent: Oct. 10, 2023

(54) MARBLE TRACK CONNECTION SYSTEM

(71) Applicant: Pike Brands LLC, Seattle, WA (US)

(72) Inventors: Jeffrey David Forgrave, Indianapolis, IN (US); Chong Piu Wong, Kowloon Bay (HK)

(73) Assignee: Pike Brands LLC, Seattle, WA (US)

( * ) Notice: Subject to any disclaimer, the term of this patent is extended or adjusted under 35 U.S.C. 154(b) by 0 days.

(21) Appl. No.: 17/504,590

(22) Filed: Oct. 19, 2021

(65) Prior Publication Data

US 2023/0120706 A1 Apr. 20, 2023

(51) Int. Cl.
*A63H 18/02* (2006.01)
*A63H 33/10* (2006.01)

(52) U.S. Cl.
CPC ..... *A63H 18/02* (2013.01); *A63H 33/101* (2013.01)

(58) Field of Classification Search
CPC ..... A63H 18/00; A63H 19/30; A63H 18/02
USPC ..... 446/168–174
See application file for complete search history.

(56) References Cited

U.S. PATENT DOCUMENTS 2,000,808 A * 5/1935 Williams ..... A63F 7/3622 446/168
3,946,516 A * 3/1976 Wirth ..... A63F 7/3622 446/117
4,171,090 A * 10/1979 Eisenburg ..... A63F 7/3622 238/10 R
4,175,665 A * 11/1979 Dogliotti ..... A47F 1/08 D6/681
4,713,038 A * 12/1987 Wichman ..... A63F 7/3622 446/168
4,874,342 A * 10/1989 Klitsner ..... A63F 7/3622 446/168
4,932,917 A * 6/1990 Klitsner ..... A63F 7/3622 446/168

(Continued)

FOREIGN PATENT DOCUMENTS

KR 101611788 B1 * 4/2018 ..... A63F 7/3622

OTHER PUBLICATIONS

Young, machine translation of KR-101611788-B1, uploaded Aug. 4, 2022, Espacenet, 4 pages.*

*Primary Examiner* — Eugene L Kim
*Assistant Examiner* — Matthew B Stanczak
(74) *Attorney, Agent, or Firm* — Maginot, Moore & Beck, LLP

(57) ABSTRACT

A marble run track connection arrangement for use with a plurality of physically interconnectable marble run elements includes a marble track section, a tube, and a connector. The marble track section has first and second connecting posts coupled to or forming a portion of a marble travel path of the marble track section. The tube includes a connecting portion configured to directly physically connect to another tube. The connecting portion passes a marble from or to the other tube. The tube also has a side opening configured to receive a marble therethrough into or out of an interior of the first tube. The tube also includes a track connector extending outward from the tube. The connector is configured to receive the first and second connecting posts and to couple to the track connector such that a path is defined between the marble travel path and the interior of the tube.

20 Claims, 8 Drawing Sheets

(56) References Cited

U.S. PATENT DOCUMENTS 5,007,876 A * 4/1991 Klitsner ..... A63F 7/3622 446/168
5,312,285 A * 5/1994 Rieber ..... A63F 7/3622 273/109
5,678,489 A * 10/1997 Wang ..... G09B 23/02 104/56
5,924,907 A * 7/1999 Tobin ..... A63F 7/386 446/168
5,947,787 A * 9/1999 Cyrus ..... A63H 33/42 446/105
D422,652 S * 4/2000 Watanabe ..... D21/564
6,056,620 A * 5/2000 Tobin ..... A63F 7/3622 273/120 R
6,536,763 B1 * 3/2003 Braun ..... A63F 7/3622 273/123 R
6,568,679 B1 * 5/2003 Sommer ..... A63F 7/042 273/153 R
D492,736 S * 7/2004 Kato ..... D21/456
6,945,839 B2 * 9/2005 Quercetti ..... A63H 18/06 104/53
7,882,788 B2 * 2/2011 Sorenson ..... A63F 7/3622 104/53
8,475,226 B2 * 7/2013 Comfort ..... A63H 33/08 446/168
8,540,545 B2 * 9/2013 Leicht ..... A63H 33/107 446/124
9,409,097 B2 * 8/2016 Comfort ..... A63H 18/02
9,956,493 B1 * 5/2018 Hunts, Jr. ..... F16B 2/22
10,653,970 B2 * 5/2020 Forgrave ..... A63F 7/3075
10,953,339 B1 * 3/2021 Liu ..... A63H 33/046
11,117,067 B2 * 9/2021 Comfort ..... A63H 18/00
2004/0198145 A1 * 10/2004 Quercetti ..... A63F 7/3622 446/166
2007/0209543 A1 * 9/2007 Beaulieu ..... A63F 7/3622 104/53
2009/0084863 A1 * 4/2009 Sorenson ..... A63F 7/3622 238/122
2010/0178840 A1 * 7/2010 Hoffman ..... A63F 7/3622 446/168
2011/0070803 A1 * 3/2011 Hoffman ..... A63F 7/3622 446/168
2012/0108139 A1 * 5/2012 Horowitz ..... A63F 7/3622 446/168
2014/0017970 A1 * 1/2014 Comfort ..... A63F 7/249 446/168
2018/0236350 A1 * 8/2018 Johnston ..... A63H 18/02
2019/0030445 A1 * 1/2019 Luo ..... A63H 33/062
2019/0038963 A1 * 2/2019 Forgrave ..... A63F 7/3622
2021/0093981 A1 * 4/2021 Forgrave ..... A63H 33/26
2021/0101087 A1 * 4/2021 Hu ..... A63H 18/028
2021/0245038 A1 * 8/2021 Forgrave ..... A63F 7/28
2022/0126217 A1 * 4/2022 Owen ..... A63H 29/10
2022/0152518 A1 * 5/2022 Shweka ..... A63H 18/02

* cited by examiner

MARBLE TRACK CONNECTION SYSTEM

FIELD OF THE INVENTION

The present invention is related to building toys, and more specifically, kits for designing and building marble run tracks.

BACKGROUND

Marble run toys known in the art have interconnecting track sections that may be arranged by a user in any of a plurality of designs. Once constructed, the track can define a downhill track through the various sections or modules. The interchangeable nature of the various module designs allows for the construction of many different marble run layouts.

FIG. 8 shows an exemplary marble run layout 10 formed of a plurality of interconnecting modules 11A, 11B, 11C, 11D, 11E, 11F and 18. The modules may take many forms, such as modules 11A, 11B and 11C, which include channels 12 that laterally direct a marble from a vertical receiving tube 14 to an exit tube 16. The channels 12 may define circuitous routes, such as those modules 11B and 11C. Other modules comprise vertical tubes 18 that can be used as part of the track, or merely as vertical support structures for other modules. Still other modules 11D can include a wide platform 20 with spikes 22 to direct the ball in an unpredictable path from the vertical receiving tube 24 and the exit tube 26. Other modules 11E can include a bowl structure. Modules having additional or alternative features are also known.

In popular marble run kits, the vertical receiving tube 14 of each module is generally designed to directly physically connect to an exit tube 16 of an upstream module, thus allowing the marble to transition downstream from module to module. In FIG. 8, most of the receiving tubes 14 are disposed within part of the exit tube 16 of an upstream module, and therefore is not in view. The modules may have other tubes or structures 28 under the vertical receiving tube 14 to allow that portion of the module to be supported from below, for example, by vertical tube modules 18. Similarly, the modules may have a bypass tube 30 disposed vertically above the exit tube 16 that may provide support as well as an alternative marble input.

One characteristic of marble run kits similar to the one shown in FIG. 8 is that receiving tube, the exit tube and channels are rigidly constructed as a single piece. The rigid relationship between the receiving tube, exit tube and marble path helps provide for predictable designs and ease of use. While the ease-of-use due to the rigid connection can be advantageous, it can also be limiting with respect to development of creative marble designs.

It would be advantageous to create a toy kit that builds on the advantages of the marble run kits and provides greater flexibility in marble path design.

SUMMARY

At least one embodiment described herein contemplates a marble run kit wherein one or more marble run tracks can be removably and flexibly connected to one or more tube modules. A marble kit with such marble run tracks and tube modules can provide for customized track builds by allowing for a non-rigid relationship between two tube modules in the marble run.

A first embodiment is a marble run track connection arrangement for use a plurality of physically interconnectable marble run elements. The connection arrangement includes a marble track section, a first tube, and a connector. The marble track section has at least first and second connecting posts coupled to or forming a portion of a marble travel path of the marble track section. The first tube includes a connecting portion configured to directly physically connect to a second tube. The connecting portion passes a marble from or to the second tube. The first tube also has a side opening configured to receive a marble therethrough into or out of an interior of the first tube. The first tube also includes a track connector extending outward from the tube. The connector is configured to receive the first and second connecting posts and to couple to the track connector, such that a first path is defined between the marble travel path and the interior of the first tube.

Another embodiment is a marble run kit that includes a plurality of marble track sections, a plurality of tubes, and a plurality of connectors. Each marble track sections has at least first and second connecting posts coupled to or forming a portion of a marble travel path. Each of at least some of the plurality of tubes includes a first connecting portion at one end of the tube, and a second connecting portion at a second end of the tube. The first connecting portion directly physically connects to a second connecting portion of another tube of the plurality of tubes. The tube has a side opening configured to pass a marble into or out of an interior of the tube. A track connector extends outward from the tube. Each connector receives the first and second connecting posts and couples to the track connector to define a first path between the marble travel path and the interior of the first tube.

The above-described features and advantages, as well as others, will become more readily apparent to those of ordinary skill in the art by reference to the following detailed description and accompanying drawings.

DETAILED DESCRIPTION

Figure 1:
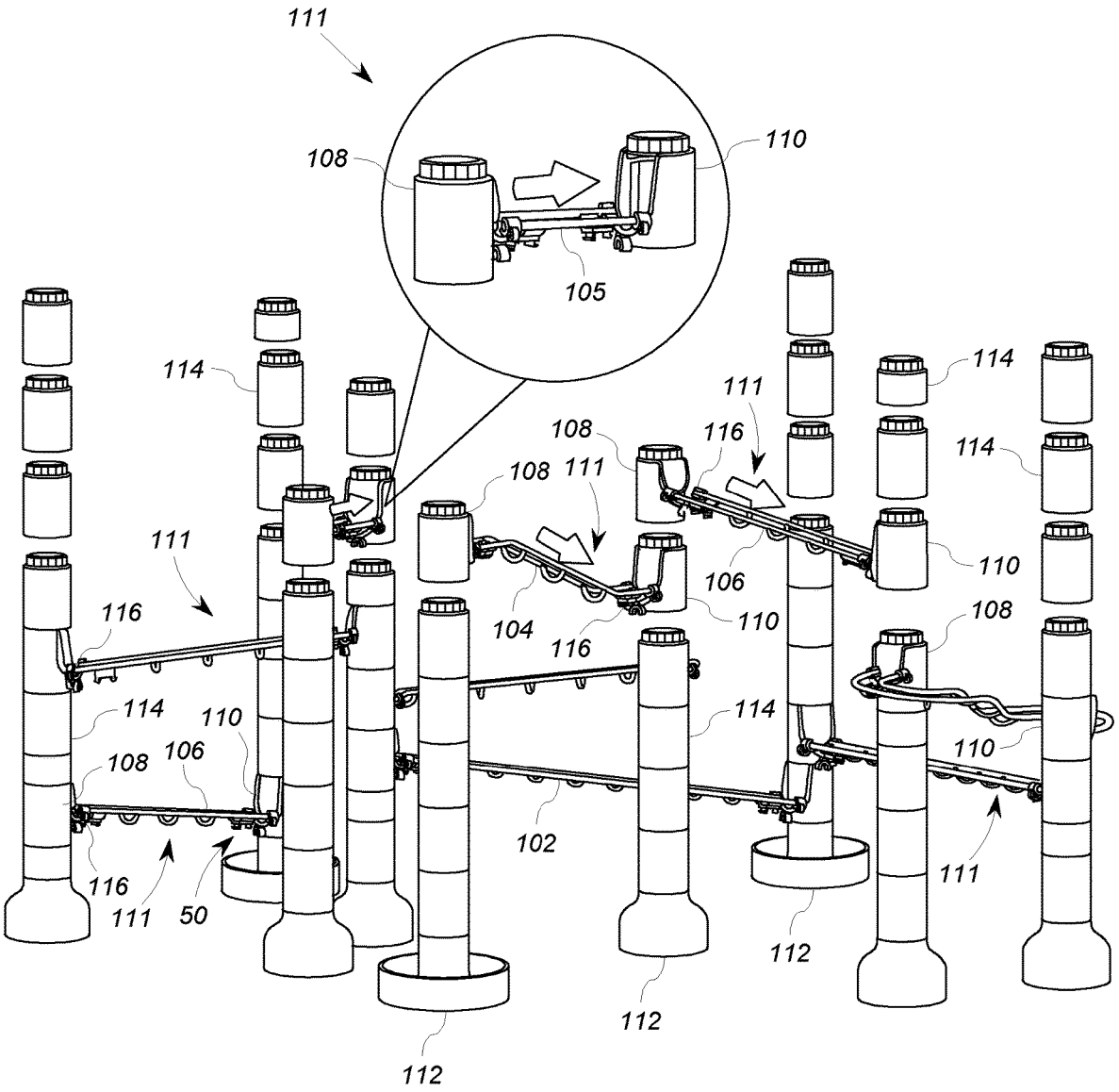
FIG. 1 shows a perspective view of an exemplary marble track kit with portions partially built into a marble track run.

FIG. 1 shows a perspective view of an exemplary marble track kit 100 according to a first embodiment, a portion of which is built into an exemplary marble run 50. It will be appreciated that the marble track kit 100 is configurable into a large number of marble runs that differ in size and/or shape from the marble run 50. The marble track kit 100 includes a plurality of marble track sections 102, 104, 105, 106, among others, feeder tubes 108, exit tubes 110, bases 112, spacer tubes 114 and a plurality of connectors 116. It will be appreciated that the marble track kit 100 may include more of any or all of the marble track sections 102, 104, 105, 106, feeder tubes 108, exit tubes 110, bases 112, spacer tubes 114 and connectors 116 than those used in the exemplary marble run 50.

Each of the marble track sections 102, 104, 105, 106 has various shapes and sizes, and may each be connected to the feeder tubes 108 and exit tubes 110. As shown in FIG. 1, the exemplary marble run 50 includes a plurality of track stages 111, each comprising one of the marble track sections 102, 104, 105, or 106, coupled between and to a feeder tube 108 and an exit tube 110 via the connectors 116. In general, the feeder tube 108 is configured to receive through a top opening and provide the marble to a connected track section 102, 104 or 106. The exit tube 110 is configured receive a marble from the connected track section 102, 104, or 106 and pass the marble through a bottom opening. The spacer tubes 114 are preferably hollow tubes that can be connected to and between each other and any of the tubes 114. The tubes 108, 110, 114 can connect to each other, and thus, stages 111 and spacer tubes 114 can be combined to form the marble run 50 or any of a large plurality of unique designs.

Figure 2:
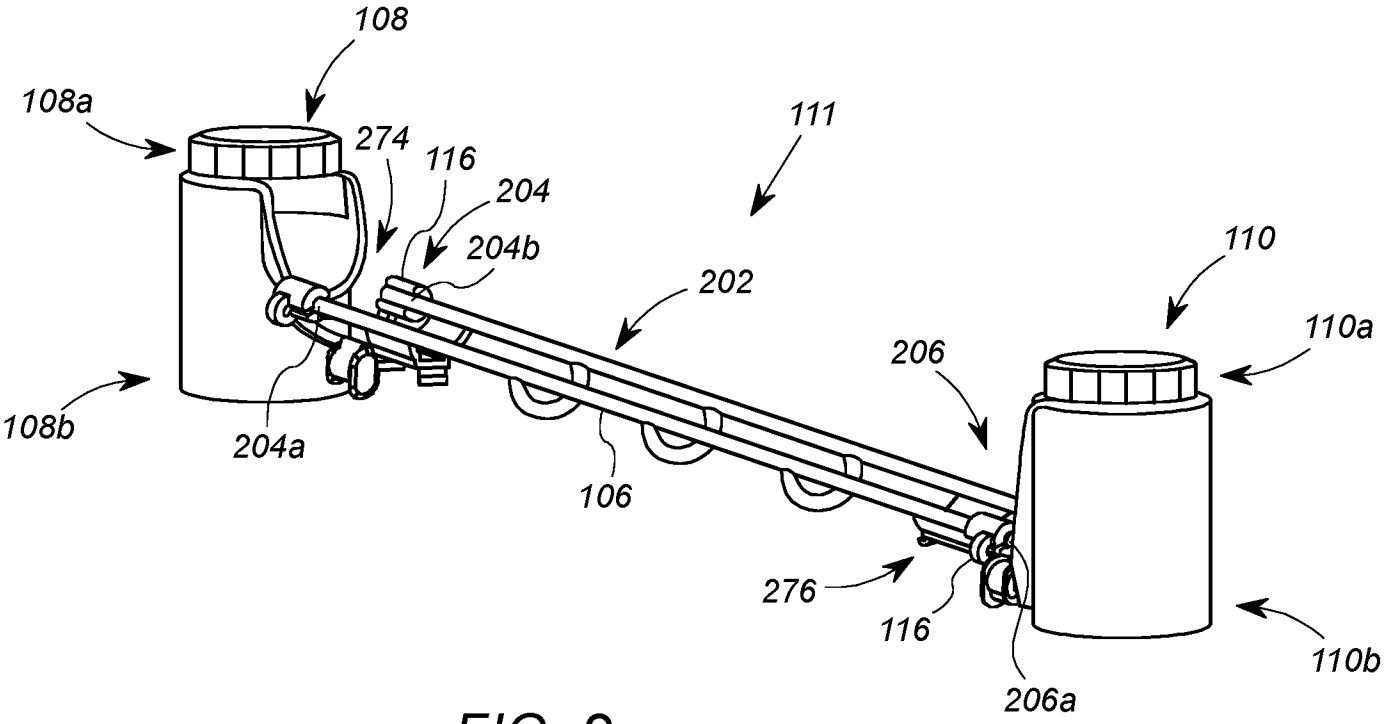
FIG. 2 shows a perspective view of part of the marble track kit assembled into a marble track stage of the marble track run of FIG. 1.

More specifically, FIG. 2 shows a plan view of an exemplary stage 111 that includes a track section 106, a feeder tube 108, an exit tube 110, and first and second connectors 116 apart from the kit 100. With reference to FIGS. 1 and 2, each of the tubes 108, 110 has a corresponding top 108*a* and 110*a*, and a corresponding bottom 108*b* and 110*b*. Each top 108*a*, 110*a* is configured to engage and attach to a bottom 108*b*, 110*b* of another tube 108, 110, and preferably also to a bottom of a spacer tube 114 (see FIG. 1). For example, the top 108*a* of the feed tube 108 is configured to engage and attach to the bottom 110*b* of the exit tube 110, as well as to the bottom 108*b* of other feed tubes 108. The bases 112 have a wide bottom designed to rest on the floor and have a top 112*a* that is configured to receiving a marble, and to connect to the bottom 108*b*, 110*b* of tubes 108, 110, and to the bottom of the spacer tube. The feeder funnel 114 has a wide top 114*a* configured to receive a marble, and is configured to provide the marble through a bottom 114*b* that is configured to connect to the top 108*a*, 110*a* of a tube 108, 110, or even the top 112*a* of the base 112. The marble track sections 102, 104, 106 connect to the tubes 108, 110 via the connectors 116.

In general use, the bottoms 110*b* of exit tubes 110 of one stage 111 are advantageously connected to the tops 108*a* of feed tubes 108 of another stage 111, either directly or via one or more intermediate spacer tubes 114, so that a marble may feed from a track section 102, 104, 106 connected to an exit tube 110 to a feeder tube 108, and from that feed tube 108 to another track section 102, 104 and 106. Thus, the tubes 108, 110, 114 and track sections 102, 104, 106 can be combined in various ways to create a wide variety of marble paths, with marbles rolling along track sections 102, 104, 106 between tubes 108, 110, and passing vertically between tubes 108, 110 directly or via spacer tubes 114. The spacer tubes 114 may be used as vertical supports as well as vertical passages for the marble. The bases 112 may be used as the terminus of the designed track.

Figure 3A:
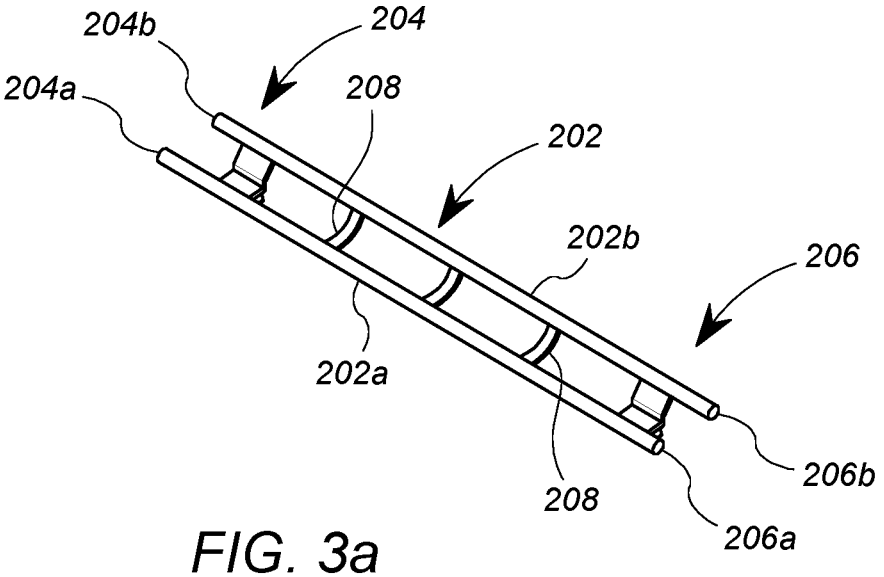
FIG. 3*a* shows a perspective view of an exemplary marble track section of the marble track kit of FIG. 1.

FIG. 3*a* shows the marble track section 106 in further detail. As shown in FIG. 3*a*, the marble track section 106 has a marble travel path 202, first and second ends 204, 206, respectively, and first, second, third and fourth connecting posts 204*a*, 204*b*, 206*a*, 206*b*, respectively.

In general, the marble travel path 202 is configured to support and guide a marble from the first end 204 to the second end 206. The first and second connecting posts 204*a*, 204*b* are disposed at the first end 204 of the marble travel path 202, and the third and fourth connecting posts 206*a*, 206*b* are disposed at the second end 206 of the marble travel path 202. In this embodiment, the marble travel path 202 includes two travel rails 202*a*, 202*b*, and a plurality of spaced-apart concave ribs 208. The concave ribs 208 extend between and support in fixed relative position the first travel rail 202*a* and the second travel rail 202*b*. The two travel rails 202*a*, 202*b* may suitable be elongate rods or pins that are disposed substantially parallel to each other (or at least are coplanar) at a distance less than the diameter of a standard marble or other marble intended for use with the marble track section 106. The distance between the rails 202*a*, 202*b* is suitable to support a standard marble, and allow the marble to roll thereon. The concavity of the concave ribs 208 is disposed to allow a portion of the marble, disposed on rails 202*a*, 202*b*, to extend below the bottom of the rails 202*a*, 202*b* without interference from the ribs 208.

It will be appreciated that in this embodiment, the first and third connecting posts 204*a*, 206*a* form the ends of the first travel rail 202*a*, and the second and fourth connecting posts 204*b*, 206*b* form the ends of the second travel rail 202*b*. In other embodiments, the marble travel path 202 may take other forms where the connecting posts 204*a*, 204*b*, 206*a* and/or 206*c* are different structures from the marble travel path 202. For example, the marble travel path 202 may take the form of any of the channels 12 of the prior art marble run modules shown in FIG. 8, in which case the connecting posts 204*a*, 204*b*, 206*a*, 206*b* would extend from opposing ends thereof.

It will be appreciated that the other marble track sections 102, 104 have the same structure with rails, connecting posts, and ribs, but have a different length. The marble kit 100 also includes marble track sections 105 that have a different shape. Preferably, all of the marble track sections 102, 104, 105 and 106 have the same connecting posts 204*a*, 204*b*, 206*a*, 206*b*, but have travel paths and travel rails that differ in length and/or shape.

Figure 3B:
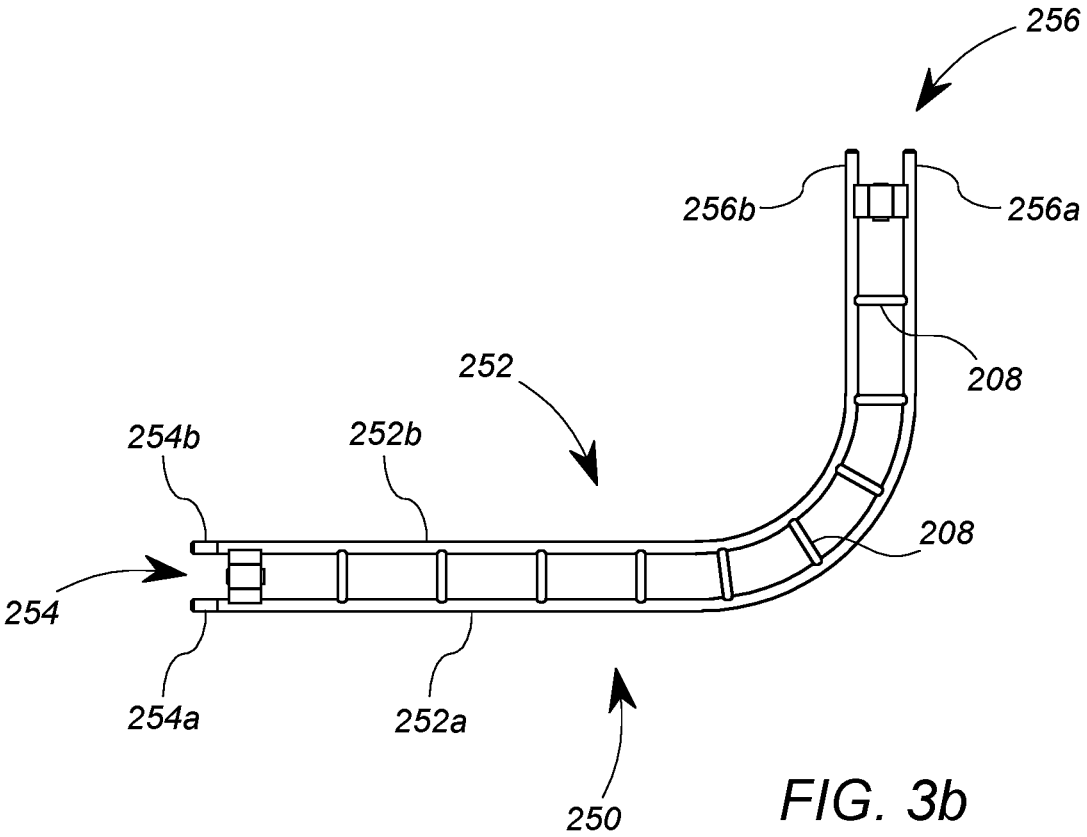
FIG. 3*b* shows a top plan view of another exemplary marble track section that may be included and used with the marble track kit of FIG. 1.

By way of example, FIG. 3*b* shows a top plan view curved marble track section 250 that may be included within the marble kit 100. As shown in FIG. 3*b*, the marble track section 250 has a curved marble travel path 252, first and second ends 254, 256, respectively, and first, second, third and fourth connecting posts 254*a*, 254*b*, 256*a*, 256*b*, respectively.

The first and second connecting posts 254*a*, 254*b* are disposed at the first end 254 of the marble travel path 252, and have the same structure as the connecting posts 204*a*, 204*b* of FIG. 3*a*. The third and fourth connecting posts 256*a*, 256*b* are disposed at the second end 256 of the marble travel path 252, and have the same structure as the connecting posts 206*a*, 206*b* of FIG. 3*a*. The marble travel path 252 includes two curved travel rails 252*a*, 252*b*, and a plurality of spaced-apart concave ribs 258. The concave ribs 258 extend between and support in fixed relative position the first curved travel rail 252*a* and the second curved travel rail 252*b*. The two travel rails 252*a*, 252*b* may suitable be elongate rods or pins that curved and arranged to extend alongside each other to support a standard marble, and allow the marble to roll thereon from the first end 254 to the second end 256 along a predefined curve.

Figure 4:
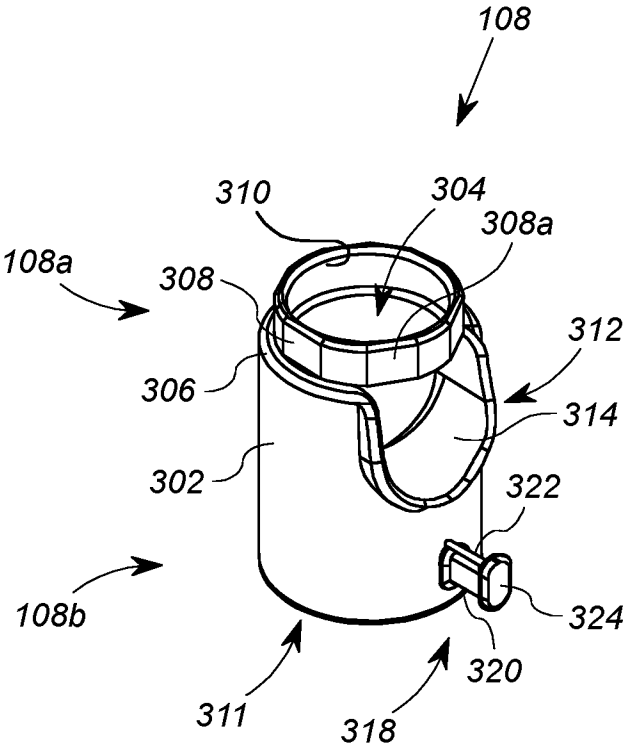
FIG. 4 shows a perspective view of a feeder tube of the marble track kit of FIG. 1.

FIG. 4 shows a perspective view of a feeder tube 108 apart from other pieces of the kit 100. In addition to the top 108*a* and bottom 108*b*, the feeder tube in this embodiment includes a tube body 302 that is generally cylindrical from the top 108*a* to the bottom 108*b*, and defines an interior 304. The top 108*a* has a base portion 306 that forms the top edge of the cylindrical tube body 302, and a connection boss 308 extending upward from the base portion 306. The base portion 306 and connection boss 308 define a top opening 310 sized to receive a toy marble therethrough.

The base portion 306 of the top 108*a* is also configured to engage the bottom of another tube 108, 110 or 114). The tube body 302 terminates at the bottom 108*b* to form an open bottom 311 configured to receive a connection boss having the same design as the connection boss 308. The tube body 302 includes a side opening 312 that is sized to receive a toy marble therethrough. Disposed in the interior 304 directly below the opening is marble ramp 314 that extends generally upward and inward from the side opening 312. As such, the marble ramp 314 guides a marble received through the top opening 310 to exit through the side opening 312.

As discussed above, the connection boss 308 in this embodiment has an outer diameter or outer perimeter that is sized to fit within and engage an open bottom of another tube 108, 110 or 114, or another marble run module having the same open bottom configuration. In this embodiment, the connection boss 308 is in the form of a generally round ring having chords 308*a* or other discontinuities on the outer perimeter. The connection boss 308 may take other shapes, such as a true polygon, a ring shape without chords 308*a*, a ring shape with fewer cords.

It will be appreciated, therefore, that multiple tubes 108 may be stacked vertically, with the connection boss 308 of each tube 108 disposed within and engaging the open bottom 311 of another tube 108. It will further be appreciated that that top 108*a* and the bottom 108*b* can compatibly connect with the tubes 110, 114, as well as many commercially available traditional marble race toys such as those shown in FIG. 8. Thus, the tubes having the design of the tube 108 may be combined with marble maze tracks of other manufacturers to combinations of marble mazes and marble model buildings. It will also be appreciated that the feeder tube 108 is formed of a single piece of injection molded plastic, which allows for ease of manufacturing in quantity.

In accordance with embodiments as described herein, the feeder tube 108 includes a track connector 318. The track connector 318 includes a shaft 320, a rib 322 and an end plate 324. The shaft 320 is a short bar or shaft extending radially outward from the tube 302 at a position below the opening 312. The end plate 324 is disposed at the end of the shaft 320 opposite the end that engages the tube body 302. The end plate 324 has a width and height that exceeds, respectively the cross-sectional width and height of the shaft 320. The rib 322 extends along the top of the shaft 324, and preferably does not have a height that extends above the vertical level of the end plate 324. As will be discussed below, the track connector 318 is configured to retain a corresponding snap connector while allowing limited vertical angular movement thereof.

Figure 5:
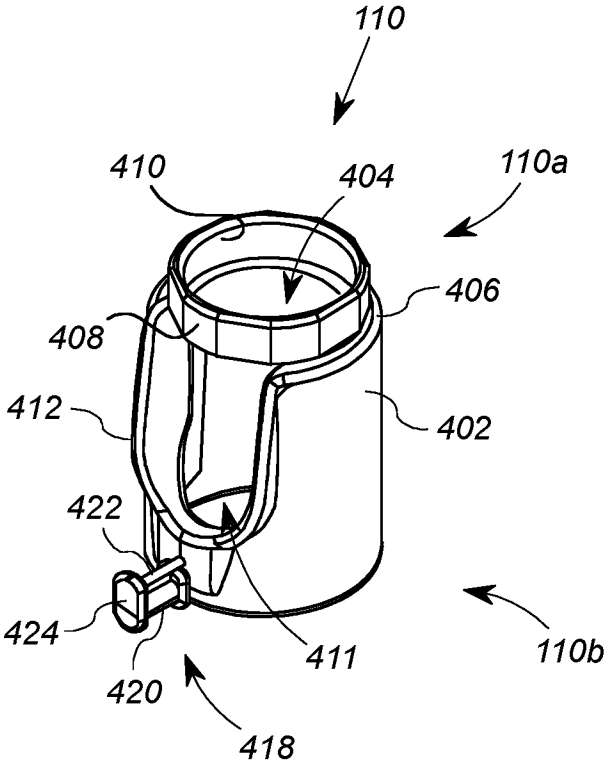
FIG. 5 shows a perspective view of an exit tube of the marble track kit of FIG. 1.

FIG. 5 shows a perspective view of an exit tube 110 apart from other pieces of the kit 100. In addition to the top 110*a* and bottom 110*b*, the exit tube 110 in this embodiment includes a tube body 402 that is generally cylindrical from the top 110*a* to the bottom 110*b*, and defines an interior 404. The top 110*a* has the same structure as the top 108*a* of the feeder tube 108, and includes a similarly designed base portion 406 that forms the top edge of the cylindrical tube body 402, and a connection boss 408 extending upward from the base portion 406. The base portion 406 and connection boss 408 may suitably define a top opening 410 sized to receive a toy marble therethrough.

The base portion 406 of the top 110*a* is also configured to engage the bottom of another tube 108, 110 or 114. The tube body 402 terminates at the bottom 110*b* to form an open bottom 411 that is substantially identical in design to the open bottom 311 of the feeder tube 108. The tube body 402 includes a side opening 412 that is sized to receive a toy marble therethrough. The tube body 402 is otherwise hollow, such that a marble received through the side opening 412 falls through the open bottom 411. Ideally, the distance between bottom of the side opening 412 and the open bottom 411 is shorter than the distance between the side opening 312 and open bottom 311 of the feeder tube 108. As such, when a marble track 102, 104, 105, 106 or 250 is coupled between the feeder tube 108 and the exit tube 110, the marble track 102, 104, 105, 106 or 250 has a downhill angle from the feeder tube side opening 312 to the exit tube side opening 412.

The connection boss 408 in this embodiment is substantially identical in function and design as the connection boss 308 of FIG. 4. Similar to the feeder tubes 108, the tubes having the design of the exit tube 110 may be combined with marble maze tracks of other manufacturers to combinations of marble mazes and marble model buildings. It will also be appreciated that the exit tube 110 is formed of a single piece of injection molded plastic, which allows for ease of manufacturing in quantity.

In accordance with embodiments as described herein, the exit tube 110 includes a track connector 418. The track connector 418 is disposed below the side opening 412. The track connector 418 in this embodiment is identical in construction to the track connector 318 of FIG. 3. Accordingly, the track connector 418 similarly includes a shaft 420, a rib 422 and an end plate 424 substantially identical to, respectively, the shaft 320, the rib 322 and the end plate 324 of FIG. 4. As will be discussed below, the track connector 418 is configured to retain a corresponding snap connector while allowing limited vertical angular movement thereof.

Figure 6B:
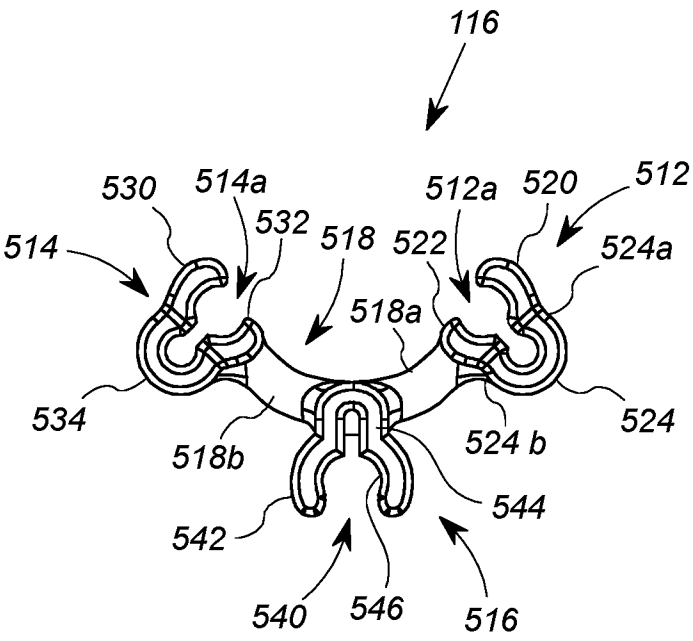
FIG. 6*b* shows a plan view of the connector of FIG. 6*a;*
Figure 6A:
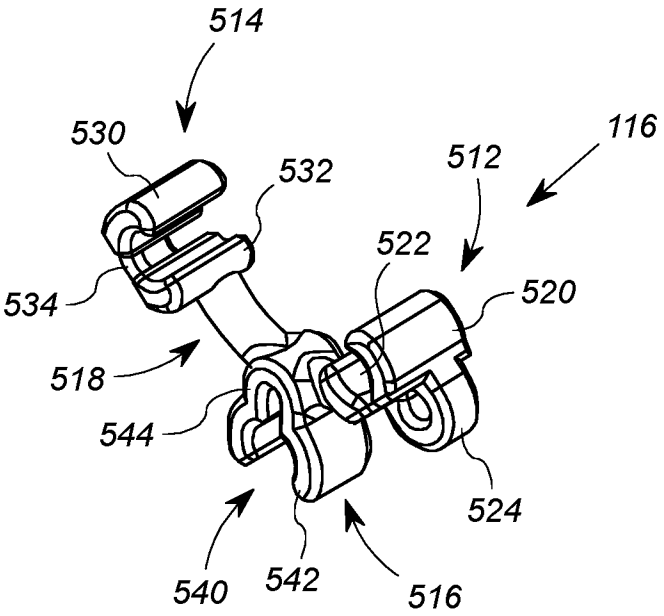
FIG. 6*a* shows a perspective view of a connector of the marble track kit of FIG. 1.

FIG. 6*a* shows a perspective view of one of the connectors 116 apart from the kit 100, and FIG. 6*b* shows a front plan view of the connector 116. With additional reference to FIGS. 3*a* and 3*b*, the connector 116 is configured to receive a pair connecting posts (e.g., the connecting posts 204*a*, 204*b*, the connecting posts 206*a*, 206*b*, the connecting posts 254*a*, 254*b*, or the connecting posts 256*a*, 256*b*) of any track section 102, 104, 105, 106 and 250. The connector 116 is further configured to couple to any of the track connectors 318, 418. FIG. 2, for example, shows a connector 116 coupled to the connecting posts 204*a*, 204*b* of the marble track section 106 and a track connector 318 of the feeder tube 108. With continued reference to FIG. 2, the connector 116 is configured to couple to the connecting posts 204*a*, 204*b* to the track connector 318 of the feeder tube 108 to define a first path 274 between the marble travel path 202 of the marble track section 106 and the interior 304 of the feeder tube 108. (See also FIG. 4). Similarly, the same connector can be used to couple to the connecting posts 206*a*, 206*b* to the track connector 418 of the exit tube 110 to define a second path 276 between the marble travel path 202 of the marble track section 106 and the interior 404 of the exit tube 110. (See also FIG. 5).

Referring again to FIGS. 6*a* and 6*b*, the connector 116 includes a first receptacle 512, a second receptacle 514, and a third flexible 516 disposed on a frame 518. The first receptacle 512 is configured to couple to a first connecting post (e.g., connecting post 204*a*) of any the plurality of marble track sections 102, 104, 105, 106 and 250. The second receptacle 514 is configured to couple to a second connecting post (e.g., connecting post 204*b*) of any of the plurality of marble track sections 102, 104, 105, 106 and 250. The third receptacle 516 is configured to couple to the track connector 318, 418 of any of the tubes 108, 110.

In this embodiment, each of the first, second and third receptacles 512, 514, and 516 is formed from flexible material. The first receptacle 512 in this embodiment includes a first and second clamp jaws 520, 522 and a flexible hinge 524 connected between the first and second clamp jaws 520, 522. With additional reference to FIG. 2 by way of example, the first and second clamp jaws 520, 522 are arranged to trap the first connecting post 204*a* between the jaws 520, 522. The flexible hinge 524 facilitates relative flexible movement of the jaws 520, 522 to allow the first connecting post 204*a* (or any connecting post) to be snap fit between the jaws 520, 522, and subsequently removed therefrom. To this end, in this embodiment, the flexible hinge 524 comprise a C-shaped member having a first end 524*a* and a second end 524*b*, and wherein the first clamp jaw 520 extends from the first end 524*a* and the second clamp jaw 522 extends from the second end 524*b*. As shown in FIG. 6*a*, the flexible hinge 524 has shorter axial length than the jaw 520, 522 to facilitate flexing for the snap fit, and/or otherwise to reduce part weight and material cost.

The second receptacle 514 has a substantially similar construction with jaws 530, 532 and a flexible hinge 534. As will be discussed below, the frame 518 is configured such that the first receptacle 512 and the second receptacle 514 are separated by a distance that corresponds to the distance between the first and second connecting posts 204*a*, 204*b* of the track section 106.

The third receptacle 516 is a clamp having an open side 540 for receiving either of the track connectors 318, 418. In this embodiment, the third receptacle includes a clamping portion 542 and a retention channel 544. The clamping portion 540 is generally a C-shaped body having the open side 540. The retention channel 544 is a U-shaped structure disposed on the frame 518, and is formed to interrupt the C-shape of the clamping portion 542.

Accordingly, the third receptacle 516 defines an interior having first chamber 546 and a second chamber 548. The first chamber 546 is configured to receive and loosely retain the track connector bar 320 (or track connector bar 420). Specifically, the first chamber 546 is larger in cross section than the connecting bar 320 to allow for vertical and lateral movement of the bar 320 within the first chamber 546. However, the opening 540 is smaller than the width of the track connector bar 320 to inhibit disengagement between the third receptacle 516 and the track connector bar 320 through the opening 540. Moreover, the first chamber 546 is smaller in cross section than the dimensions of the end plate 324 to inhibit axial disengagement between the third receptacle 516 and the connecting tab bar 320.

The loose fit of the connecting tab bar 320 within the first chamber 546 allows for the track section 106 to extend at different vertical angles from the feeder tube 108 (and likewise, when so connected, from the exit tube 110). This not only allows the user flexibility in designing marble runs, but also allows for track modules 102, 104, 106 of different lengths with the same tubes 108, 110 at the same heights. Specifically, the vertical displacement between the openings 312, 412 of tubes 108, 110 is consistent in the various stages 111 shown in FIG. 1. As a result, the shorter track modules 105, 106 will decline at a steeper angle in their stages 111, as compared to longer track modules 102, which will decline at a lesser angle. Thus, the loose fit of the connecting tab bar 320 within the first chamber 546 allows the same tubes 108, 110 and connectors 116 to be used with various lengths and even shapes of marble track sections 102, 104, 105, 106 and 250.

The second chamber 548 is defined by the U-shaped structure of the retention channel 544, and is configured to receive the fin 322 of the track connector 318 (or the fin 422 of the track connector 418) to inhibit lateral movement of the track connector 318 (or 418) with respect to the connector 116.

The frame 518 in this embodiment includes a first arm 518*a* and a second arm 518*b*. The first arm 518*a* extends from a first side of the retention channel 544 to the second jaw 522 of the first receptacle 512, and the second arm 518*b* extends from the second side of the retention channel 544 to the second jaw 532 of the second receptacle 514. It will be appreciated that the frame is configured such that the open sides 512*a*, 514*a* of the first and second receptacles 512, respectively, 514 face away from the open side 540 of the third receptacle 514. As shown in FIG. 2, this arrangement allows for the connector 116 to be supported on the track connector 318 (or alternative track connector 418), while the connecting posts 204*a*, 204*b* are supported on the connector 116.

FIG. 2 shows the interconnection between the connector 116 and the connecting posts 204*a*, 204*b* used to assemble the stage 111. The connector 116 interconnects any of the tubes 108, 110 with the connecting posts of any of the track sections 102, 104, 105, 106, and 250 in the same manner. As discussed above, the flexibility in the connection due the relative sizing of the first chamber 546 of the third receptacle 516 and connecting tab bars 320, 420 of the tubes 108, 110, respectively, allow a single design of the connector 116 (and tubes 108, 110) to be used with different sizes and shapes of marble track sections, and even facilitates the use of spacer tubes 114 of multiple heights, such as those shown in FIG. 1.

Figure 8:
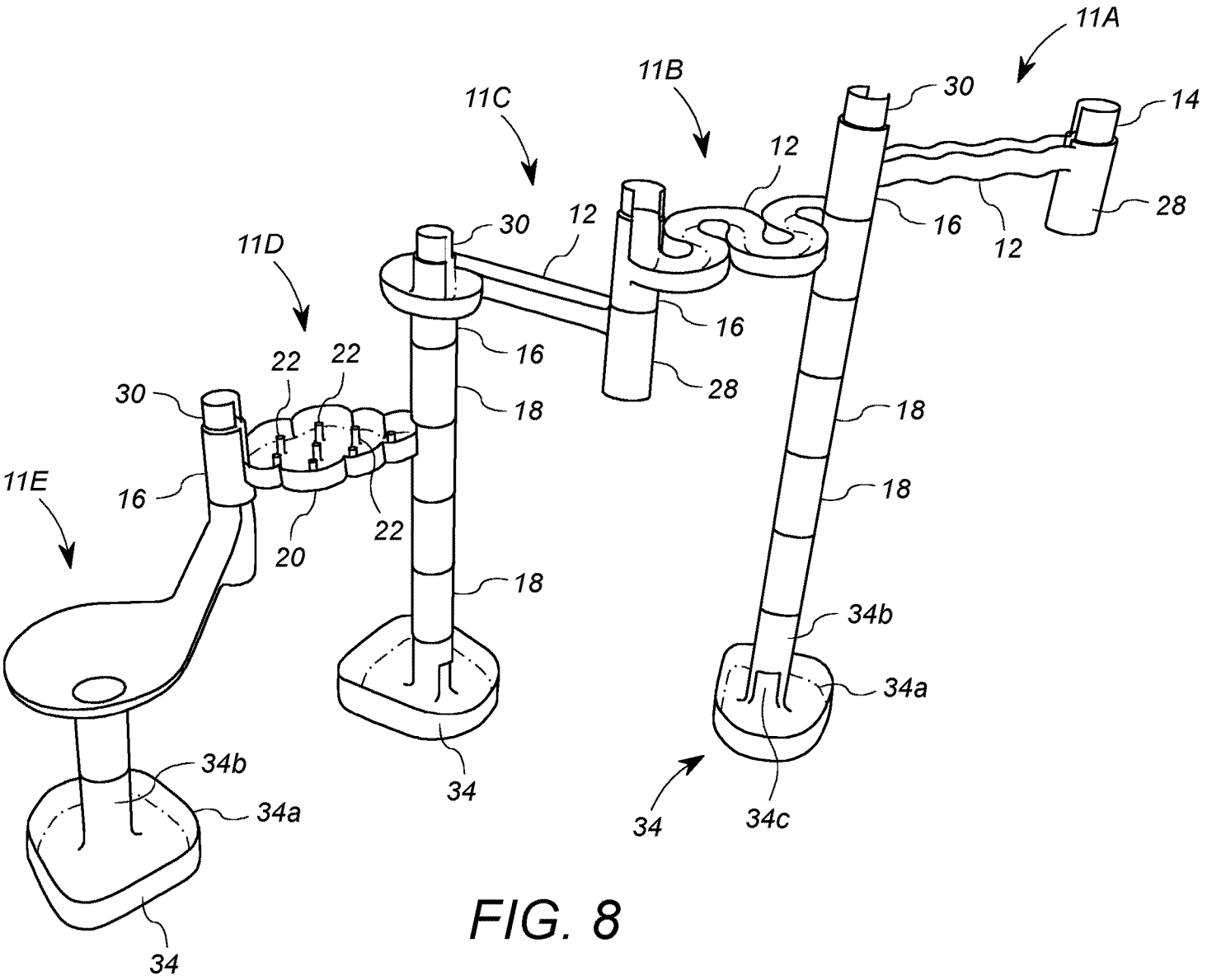
FIG. 8 shows a prior art marble run employing marble run modules according to the prior art.

As discussed above, the tubes 108, 110 and 114 can be interconnected with prior art marble run pieces, such as those shown in FIG. 8. Such interconnectability allows for marble runs that use traditional pieces as shown in FIG. 8 with the marble track stages 111 shown in FIGS. 1 and 2. In some embodiments, a marble run kit may include some or all of the traditional marble run pieces shown in FIG. 8 with one or more of the track sections 102, 104, 105, 106, and 250, feeder tubes 108, exit tubes 110, and connectors 116.

Figure 7A:
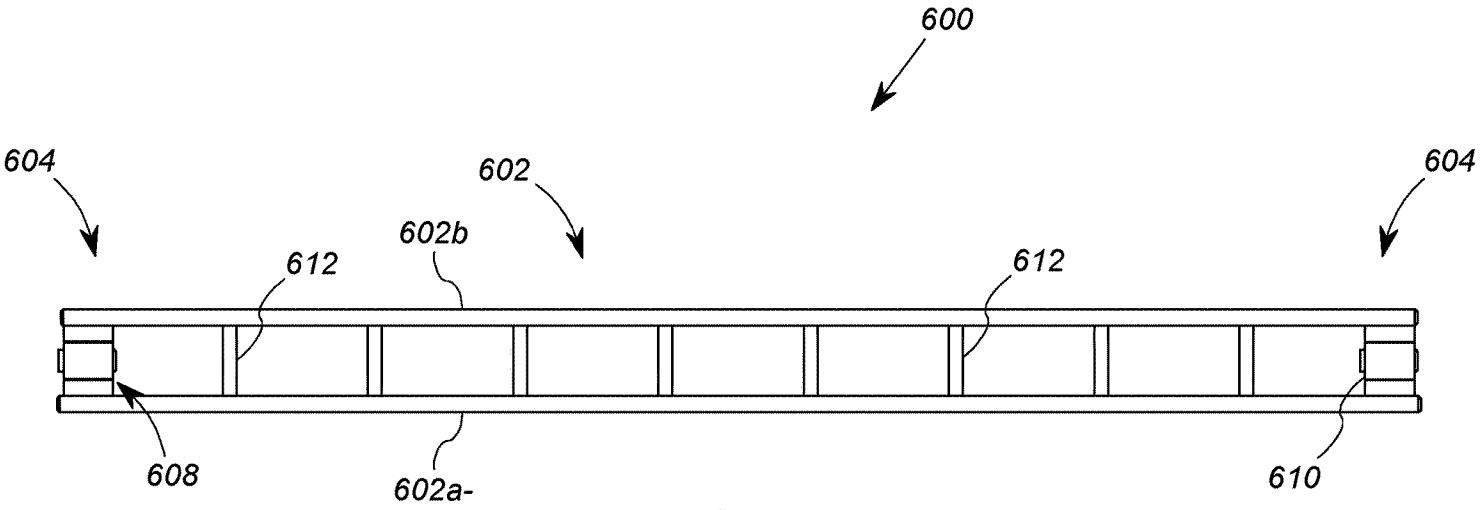
FIG. 7*a* shows a top plan view of an alternative embodiment of a marble track section that may be used in accordance with an embodiment.
Figure 7B:
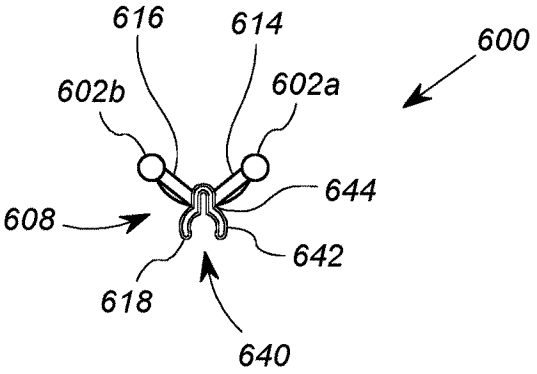
FIG. 7*b* shows an end plan view of the marble track section of FIG. 7*a;*

It will be appreciated that many of the advantages of the embodiments described above may be obtained by marble run kit that uses integrated track sections and connectors. For example, FIGS. 7*a* and 7*b* show an exemplary alternative track section 600 that may be used in place a track section (e.g. track section 102) and two connectors 116 in the embodiment of FIG. 1. FIG. 7*a* shows a top plan view of the track section 600, and FIG. 7*b* shows an end plan view of the track section 600

As shown in FIG. 7*a*, the marble track section 600 has a marble travel path 602, first and second ends 604, 606, respectively, and first and second integrated connectors 608 and 610, respectively. The first integrated connector 608 is disposed at the first end 604 of the marble track section 600, and the second integrated connector 610 is disposed at the second end 606 of the marble track section 600. In at least some embodiments, the first and second integrated connectors 608 and 610 are integrally molded with the marble travel path 602.

The marble travel path 602 includes two travel rails 602*a*, 602*b*, and a plurality of spaced-apart concave ribs 612. The concave ribs 612 extend between and support in fixed relative position the first curved travel rail 602*a* and the second curved travel rail 602*b*. The two travel rails 602*a*, 602*b* may suitable be elongate rods or pins that curved and arranged to extend alongside each other to support a standard marble, and allow the marble to roll thereon from the first end 604 to the second end 606.

The first integrated connector 608 includes a first mounting arm 614, a second mounting arm 616, and a receptacle 618. The receptacle 618 preferably has the same structure as the third receptacle 516 of the connector 116 in the embodiment of FIGS. 6*a* and 6*b*. Thus, the receptacle 618 has an open side 640 for receiving either of the track connectors 318, 418 of the tubes 108, 110, respectively. The receptacle 618 has a clamping portion 642 and a retention channel 644 identical in structure to the clamping portion 542 and the retention channel 544, respectively, of FIGS. 6*a* and 6*b*. Thus, the clamping portion 642 is configured to receive and loosely retain the track connector bar 320 (or track connector bar 420), and the retention channel 644 is configured to receive the fin 322 (or fin 422).

As shown in FIGS. 7*a* and 7*b*, the first mounting arm 608 is coupled between the first travel rail 602*a* and the outer surface of the retention channel 644 of the receptacle 618, and the second mounting arm 610 is coupled between the second travel rail 602*b* and another part of the outer surface of the retention channel 644 of the receptacle 618. Specifically, the first mounting arm 608 and the second mounting arm 610 rigidly support the receptacle 618 at a location below, but laterally between the first travel rail 602*a* and the second travel rail 602*b*. In such position, the receptacle 618 can couple to the track connector 318 of the feeder tube 108 to define a first path between the marble travel path 602 of the marble track section 600 and the interior 304 of the feeder tube 108, or alternatively, to the track connector 418 of the exit tube 110 to define a second path between the marble travel path 602 and the interior 404 of the exit tube 110.

The second integrated connector 610 has the identical structure and function as the first integrated connector 608. It will be appreciated that alternative embodiments of the integrated marble track section 600 have different marble path lengths and shapes, by way of example, the marble path lengths and shapes of the track sections 104, 105, 106, and 250, discussed above.

Figure 9A:
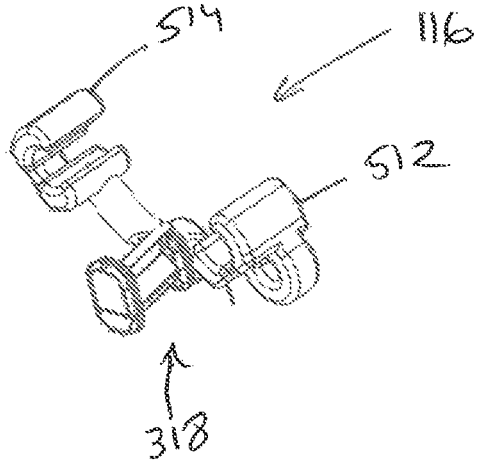
FIG. 9*a* shows a perspective view of an alternative version of the connector of FIG. 6*a*.
Figure 9B:
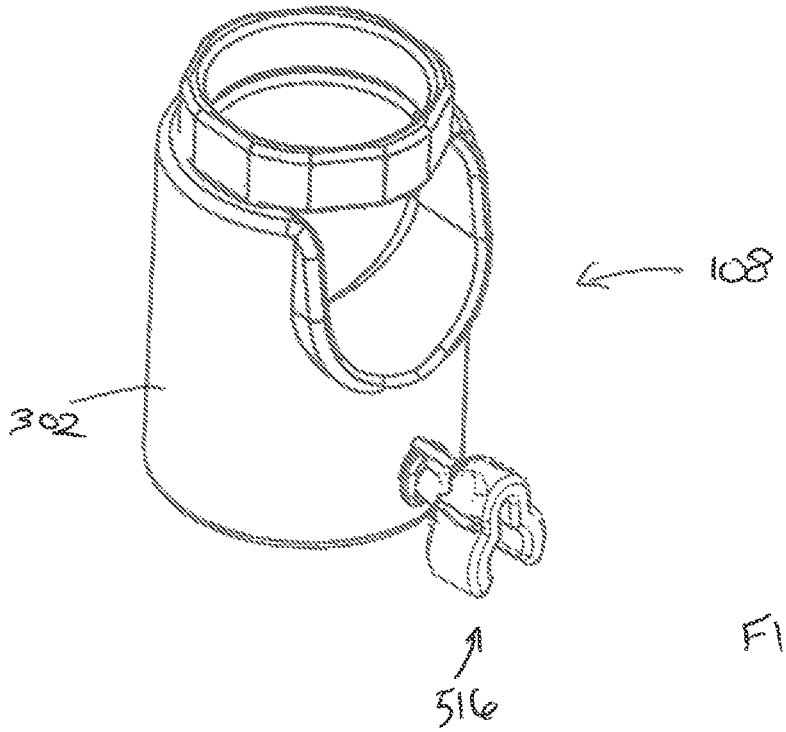
FIG. 9*b* shows a perspective view of an alternative version of the feeder tube of FIG. 4.

It will further be appreciated that the designs of the track connectors 318, 418 and the receptacles 516, 618 may be swapped while still maintaining many of the advantages of the design described above. In other words, as shown in FIG. 9*a*, the receptacles 516, 618 on respective connectors 116, 608 may be replaced by the structure of the track connector 318 of the feeder tube 108, and as shown in FIG. 9*b*, the track connector 318 on the feeder tube 108 could be replaced with the structure receptacle 516, suitably mounted to extend from the feeder tube 108 such that the receptacle 516 is disposed in the same general location as the connecting tab bar 320 of FIG. 4.

It will be appreciated that the above-described embodiments are merely exemplary and that those of ordinary skill in the art may readily devise their own implementations and modifications that incorporate the principles of the present invention and fall within the spirit and scope thereof.

What is claimed is:

1. A marble run track connection arrangement for use with a plurality of physically interconnectable marble run elements, the connection arrangement comprising:

a marble track section having at least first and second connecting posts coupled to or forming a portion of a marble travel path of the marble track section;

a first tube including a connecting portion configured to directly physically connect to a second tube, the connecting portion configured to pass a marble from or to the second tube, the first tube having a side opening configured to receive a marble therethrough into or out of an interior of the first tube, the first tube including a track connector extending outward from the tube; and a connector configured to receive the first and second connecting posts and to couple to the track connector, such that when the connector receives the first and second connecting posts, and couples to the track connector, a first path is defined between the marble travel path and the interior of the first tube.

2. The marble track connection arrangement of claim 1, wherein the connector includes first, second and third flexible receptacles, the first receptacle configured to couple to the first connecting post, the second receptacle configured to couple to the second connecting post, and the third receptacle configured to couple to the track connector.

3. The marble track connection arrangement of claim 2, wherein the first flexible receptacle includes a first and second clamp jaws and a flexible hinge connected between the first and second clamp jaws.

4. The marble track connection arrangement of claim 3, wherein the flexible hinge comprise a C-shaped member having a first end and a second end, and wherein the first clamp jaw extends from the first end and the second clamp jaw extends from the second end.

5. The marble track connection arrangement of claim 2, wherein each of the first and second receptacles is a clamp having an open side for receiving one of the first and second rails, and the third receptacle is a clamp having an open side for receiving the track connector.

6. The marble track connection of arrangement of claim 5, wherein the open sides of the first and second receptacles face away from the open side of the third receptacle.

7. The marble track connection arrangement of claim 6, wherein the third receptacle includes a clamping portion and a retention channel, the clamping portion extending from the open side of the third receptacle to the retention channel, and configured to receive a track connector bar of the track connector, the retention channel configured to receive a fin on the track connector bar to constrict lateral movement thereof.

8. The marble track connection arrangement of claim 7, wherein the track connector includes the track connector bar and the fin extending therefrom, the fin having a width that is less than a width of the track connector bar.

9. The marble track connection arrangement of claim 1, wherein the first connecting post forms a part of a first travel rail that extends a length of the marble travel path, the second connecting post forms part of a second travel rail that extends the length of the marble travel path, and wherein the first travel rail and the second travel rail are configured to cooperatively guide a marble through the marble travel path.

10. The marble track connection arrangement of claim 9, wherein the marble travel path further comprises a plurality of spaced-apart concave ribs that extend from the first travel rail to the second travel rail.

11. A marble run kit comprising:

a plurality of marble track sections, each having at least first and second connecting posts coupled to or forming a portion of a marble travel path;

a plurality of tubes, each tube of at least some of the plurality of tubes including a first connecting portion at one end of the tube, and a second connecting portion at a second end of the tube, the first connecting portion configured to directly physically connect to a second connecting portion of another tube of the plurality of tubes, the tube having a side opening configured to pass a marble into or out of an interior of the tube, the tube including a track connector extending outward from the tube; and a plurality of connectors, each connector configured to receive the first and second connecting posts and to couple to the track connector, such that when the connector receives the first and second connecting posts, and couples to the track connector, a first path is defined between the marble travel path and the interior of the first tube.

12. The marble run kit of claim 11, wherein the plurality of tubes includes a first set of tubes, each of the first set of tubes defining a marble path in the interior of the tube between the side opening and through the first connecting portion of the tube.

13. The marble run kit of claim 12, wherein the plurality of tubes includes a second set of tubes, each of the second set of tubes having a guide plate in the interior of the tube defining a marble path between the interior of the tube and the side opening.

14. The marble run kit of claim 13, wherein the marble travel paths of the plurality of marble track sections have at least two different path lengths.

15. The marble run kit of claim 13, wherein the marble travel paths of the plurality of marble track sections have at least two different path shapes.

16. The marble track connection arrangement of claim 11, wherein each connector includes first, second and third flexible receptacles, the first receptacle configured to couple to the first connecting post of one of the plurality of marble track sections, the second receptacle configured to couple to the second connecting post of the one of the plurality of marble track sections, and the third receptacle configured to couple to the track connector of one of the tubes.

17. The marble run kit of claim 16, wherein the marble travel paths of the plurality of marble track sections have at least two different path lengths or at least two different path shapes.

18. A marble run track connection arrangement for use with a plurality of physically interconnectable marble run elements, the connection arrangement comprising:

a marble track section having at least first and second travel rails forming a marble travel path of the marble track section;

a first tube including a connecting portion configured to directly physically connect to a second tube, the connecting portion configured to pass a marble from or to the second tube, the first tube having a side opening configured to receive a marble therethrough into or out of an interior of the first tube; and a connector coupled to the first and second travel rails and configured to couple to the first tube such that a first path is defined between the marble travel path and the interior of the first tube, and such that the marble track section is capable of limited vertical angular movement with respect to the first tube; and wherein one of the first tube and the connector includes a connector bar, and the other of the first tube and the connector includes a clamp configured to snap-fit connect to the connector bar.

19. The marble run track of claim 18, wherein the clamp includes an opening and a receptacle, the opening configured to receive the connector bar therethrough into the receptacle, the opening being narrower than the connector bar when the connector bar is disposed in the receptacle.

20. The marble run track of claim 19, wherein the receptacle is wider than the connector bar to allow relative lateral and vertical movement therebetween.

* * * * *